US007927072B2

(12) United States Patent
Boury et al.

(10) Patent No.: US 7,927,072 B2
(45) **Date of Patent: *Apr. 19, 2011**

(54) HOLLOW ROTOR BLADE FOR THE TURBINE OF A GAS TURBINE ENGINE

(75) Inventors: Jacques Boury, Saint Ouen en Brie (FR); Maurice Judet, Dammarie les Lys (FR)

(73) Assignee: SNECMA, Paris (FR)

( * ) Notice: Subject to any disclaimer, the term of this patent is extended or adjusted under 35 U.S.C. 154(b) by 1323 days.

This patent is subject to a terminal disclaimer.

(21) Appl. No.: 11/625,395

(22) Filed: Jan. 22, 2007

(65) Prior Publication Data

US 2010/0254823 A1 Oct. 7, 2010

Related U.S. Application Data

(63) Continuation of application No. 10/909,360, filed on Aug. 3, 2004, now Pat. No. 7,192,250.

(30) Foreign Application Priority Data

Aug. 6, 2003 (FR) ..... 03 09688

(51) Int. Cl.
*F01D 5/18* (2006.01)

(52) U.S. Cl. ..... 416/97 R; 415/115

(58) Field of Classification Search ..... 416/90 R, 416/92, 96 R, 96 A, 97 R, 224; 415/115–116, 415/173.4, 173.5

See application file for complete search history.

(56) References Cited

U.S. PATENT DOCUMENTS

| | | | | |
|---|---|---|---|---|
| 4,589,823 | A | 5/1986 | Koffel | |
| 5,348,446 | A | 9/1994 | Lee et al. | |
| 5,660,523 | A | 8/1997 | Lee | |
| 6,224,337 | B1 | 5/2001 | Lieland et al. | |
| 6,231,307 | B1 | 5/2001 | Correia | |
| 6,602,052 | B2 | 8/2003 | Liang | |
| 6,790,005 | B2 | 9/2004 | Lee et al. | |
| 6,916,150 | B2 | 7/2005 | Liang | |
| 7,192,250 | B2 * | 3/2007 | Boury et al. | 416/97 R |

FOREIGN PATENT DOCUMENTS

| | | |
|---|---|---|
| EP | 0 816 636 A1 | 1/1998 |
| EP | 1 270 873 A2 | 1/2003 |
| FR | 2 563 571 A1 | 10/1985 |

* cited by examiner

*Primary Examiner* — Christopher Verdier

(74) *Attorney, Agent, or Firm* — Oblon, Spivak, McClelland, Maier & Neustadt, L.L.P.

(57) ABSTRACT

A hollow blade includes an internal cooling passage, an open cavity located at the tip of the blade and bounded by an end wall and a rim and cooling channels that connect the internal cooling passage to the outer face of the pressure wall. The cooling channels are inclined to the pressure wall in such a way that they emerge on the outer face of the pressure wall near the top of the rim. A reinforcement of material is present between the rim and the end wall of the cavity along at least one portion of the pressure wall, whereby the rim is widened at its base adjacent to the end wall in such a way that the cooling channels emerge near the top of the rim without reducing the mechanical strength of the tip of the blade.

7 Claims, 3 Drawing Sheets

HOLLOW ROTOR BLADE FOR THE TURBINE OF A GAS TURBINE ENGINE

The present application is a continuation application of application Ser. No. 10/909,360, now U.S. Pat. No. 7,192,250, filed on Aug. 3, 2004, which claims priority to French Application Serial No. 03 09688, filed on Aug. 6, 2003. The present application claims priority to French Application Serial No. 03 09688, and the present application incorporates the entire contents of U.S. patent application Ser. No. 10/909,360, herein by reference.

The invention relates to a hollow rotor blade for the turbine of a gas turbine engine, in particular for a high-pressure turbine.

More precisely, the present invention relates to the production of a hollow blade of the type that comprises an internal cooling passage, an open cavity located at the tip of the blade and bounded by an end wall extending over the entire tip of the blade and a rim (or edge of flange) extending between the leading edge and the trailing edge along the suction wall and along the pressure wall, and cooling channels that connect the internal cooling passage to the outer face of the pressure wall, the cooling channels being inclined to the pressure wall in such a way that they emerge on the outer face of the pressure wall near the top of the rim.

The cooling channels of this type are intended to cool the tip of the blade, as they allow a jet of cooling air to be discharged, from the internal cooling passage, towards the tip of the blade at the upper end of the outer face of the pressure wall. This jet of air creates "thermal pumping " namely a reduction in the temperature of the metal by the heat absorption in the core of the metal wall, and a film of cooling air that protects the tip of the blades on the pressure side.

Owing to the high working velocities at the tips of these blades and the temperature to which these blades are subjected, it is in fact necessary to cool them so that their temperature remains below that of the gases in which they are working.

It is for this reason that, conventionally, the blades are hollow in order to allow them to be cooled by the air present in an internal cooling passage.

Furthermore, it is known to provide, at the tip of the blade, an open cavity, also called a "squealer "(or "bathtub "): this recessed shape of the blade tip limits the facing surfaces between the tip of the blade and the corresponding annular surface of the turbine casing, so as to protect the body of the blade from damage caused by any contact with an annular segment.

Documents U.S. Pat. No. 6,231,307 and EP 0 816 636 disclose such a hollow blade which is further provided with cooling channels connecting the internal cooling passage to the outer face of the rim of the cavity on the pressure face.

These cooling channels located on one side of the pressure wall thus make it possible to expel, from the internal cooling passage, a jet of air colder than that surrounding the pressure wall, this jet of air forming a film of cooling air which is localised on the outer face of the pressure wall and is sucked in towards the suction wall.

In document U.S. Pat. No. 6,231,307, these inclined cooling channels connect the internal cooling passage to the outer face of the rim of the cavity on the pressure wall, these channels being arranged (see FIG. 2 of that document) so as to pass through the end wall of the cavity and the rim of the cavity on the pressure wall, passing through the cavity.

This solution therefore requires a large thickness of material, whether for the end wall of the cavity or for the rim of the cavity, so as not to jeopardise the thermomechanical strength characteristics of the blade tip. In addition, this solution very greatly reduces the stream of cooling air reaching the top of the rim, since most of the stream leaves the internal cooling passage via the first section of the cooling channels and enters the cavity directly, without ending up on the outer face of the pressure wall.

The solution provided by document EP 0 816 636, which can be seen in FIG. 5 of the document, consists in placing these cooling channels in such a way that they pass through the pressure wall, opening onto the outer face of this pressure wall at the base of the rim of the cavity.

Here again, this solution requires a large thickness of material, whether for the end wall of the cavity or for the rim of the cavity, so as not to jeopardise the thermomechanical strength characteristics at the blade tip.

However, owing to the ever higher operating temperatures of turbines, the above solutions do not presently allow a hollow blade to be produced with sufficient tip cooling.

This is because, to maintain a sufficient thermomechanical strength around the cooling channels, the use of larger wall thicknesses very considerably increases the weight of the moving wheel(s) of the turbine. Consequently, since the greater the thicknesses of material the higher the temperature, owing to less rapid cooling, such large thicknesses of material do not make it possible to achieve blade tip cooling sufficient to allow the turbine to operate at the desired higher temperatures.

It should be noted that if the cooling is insufficient at the tip of the blade, local burning may occur, possibly resulting in metal losses that increase the clearances, thereby impairing the aerodynamic efficiency of the turbine. When the temperature of the rim of the cavity increases too greatly, there is also the risk of burning with degradation of the metal wall.

The present invention aims to solve the aforementioned problems.

Consequently, the object of the present invention is to provide a hollow rotor blade for the turbine of a gas turbine engine, of the aforementioned type, allowing the tip of the blade to be cooled sufficiently so as to improve its reliability without reducing the aerodynamic and thermomechanical characteristics of the blade.

For this purpose, according to the invention, the rim forms a thin wall and a reinforcement of material is present between the rim and the end wall of the cavity along at least one portion of the pressure wall, the face of the reinforcement turned towards the cavity being approximately plane, whereby the rim is widened at its base adjacent to the end wall in such a way that the cooling channels emerge near the top of the rim without reducing the mechanical strength of the tip of the blade.

In this way, it will be understood that, owing to the presence of the material reinforcement, the cooling channels may thus emerge closer to the top of the rim without altering the distance between these cooling channels and the end wall of the cavity.

This is because such material reinforcement results in an additional thickness in that part of the blade tip where the rim and the end wall join, on the inside of the cavity.

Such a reinforcement is also easy to effect without modifying the process for manufacturing the blade, as all that is required is to provide a larger amount of metal at this point, right from the casting step, for example during the design of the mould corresponding to this portion of the blade.

This solution also has the additional advantage of not making the structure of the blade appreciably heavier.

In general, thanks to the solution according to the present invention, it is possible to improve the cooling generated at the tip of the blade, especially level with the top of the rim of the pressure wall, by means of the air leaving the cooling channels without modifying the thermomechanical and aerodynamic characteristics of the blade.

Preferably, the face of the said reinforcement turned towards the cavity makes, with the face of the end wall turned towards the cavity, an angle (α) between 170° and 100°, preferably between 135° and 110°.

According to a preferred embodiment, the angle (α) is approximately equal to 112° .

Such an arrangement makes it possible to optimize the thermal pumping phenomenon and to increase the cooling of the vertical wall of the "squealer ", that is to say the rim of the open cavity.

Preferably, the face of the reinforcement turned towards the cavity is approximately parallel to the direction of the cooling channels.

This preferred embodiment makes it possible to achieve better mechanical reinforcement with the minimum of material at the reinforcement.

According to another preferred embodiment, the distance (A) between the outlet of the cooling channels and the top of the rim is less than the distance (B) between the outlet of the cooling channels and the face of the reinforcement turned towards the cavity.

This arrangement makes it possible to place the outlet of cooling channels as close as possible to the top of the rim, which is cooled very effectively.

According to a preferred and advantageous embodiment, the distance (B) between the outlet of the cooling channels and the face of the reinforcement turned towards the cavity is at least equal, and in particular exactly equal, to the distance (C) that separates the intersection (Cl) between the inner face of the rim level with the suction wall and the face of the end wall turned towards the cavity from the intersection (C2) between the outer face of the suction wall and the face of the end wall turned away from the cavity.

This results in, at the location of the reinforcement, and therefore on the pressure wall side of the blade tip, a structure as strong as that at the blade tip on the suction wall side.

Other advantages and features of the invention will become apparent on reading the following description given by way of example and with reference to the appended drawings in which.

Figure 1:
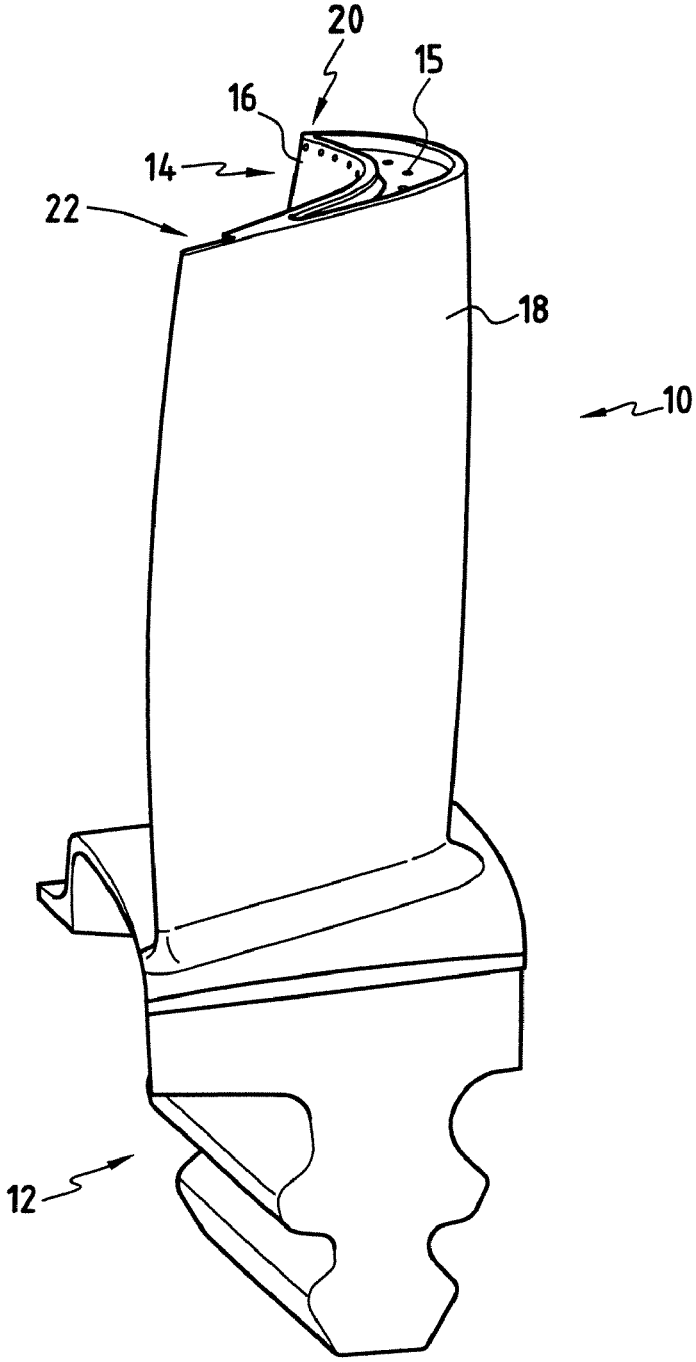
FIG.1 PRIOR ART
FIG. 1 shows a perspective view of a conventional hollow rotor blade for a gas turbine.
Figure 2:
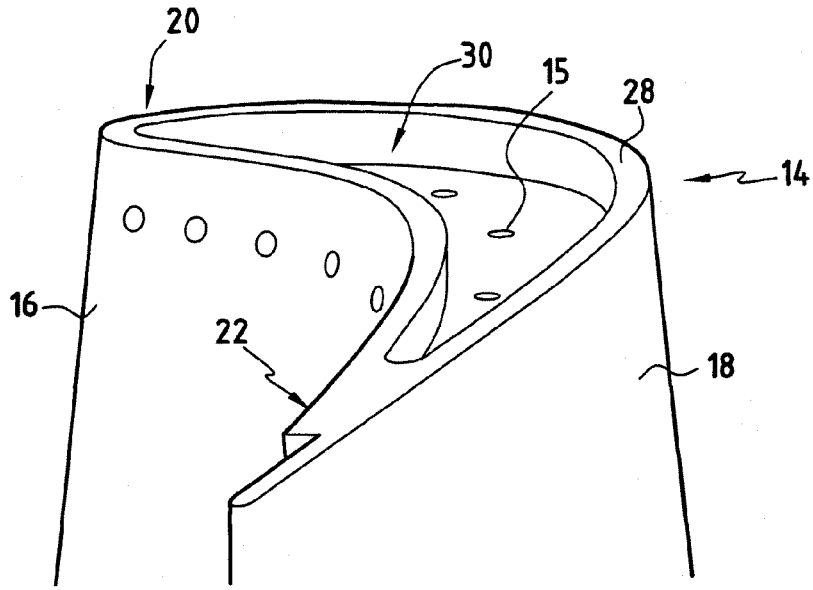
FIG.2 PRIOR ART
FIG. 2 shows in perspective, on an enlarged scale, the tip of the blade of FIG. 1.
Figure 3:
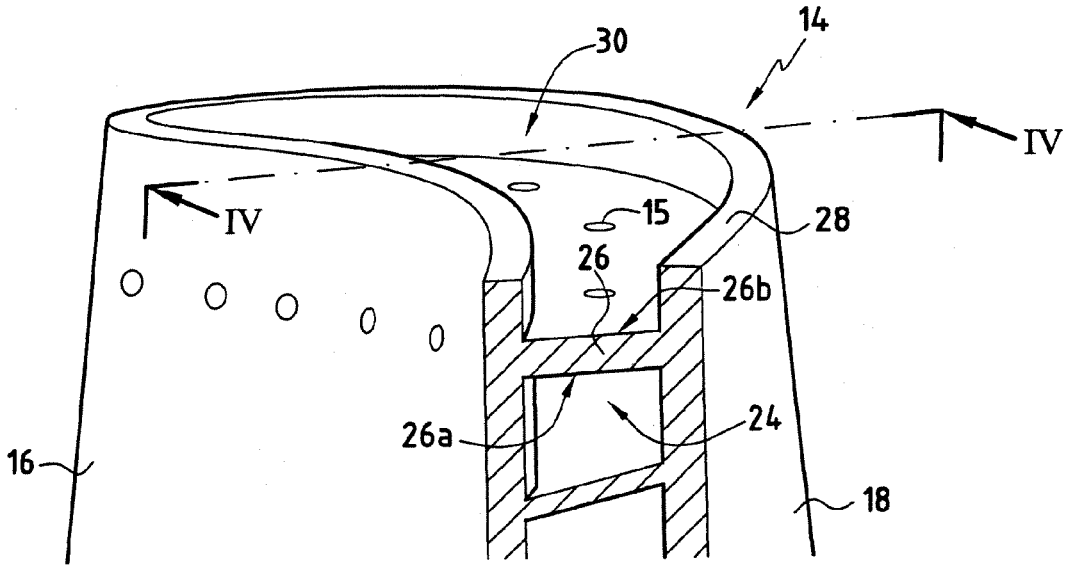
FIG.3 PRIOR ART
FIG. 3 is a view similar to FIG. 2, after the trailing edge of the blade has been removed by a longitudinal cut.

FIG. 1 shows, in perspective, an example of a conventional hollow rotor blade 10 for a gas turbine. Cooling air (not represented) flows within the blade from the base of the blade root 12 in the radial (vertical) direction towards the blade tip 14 (at the top in FIG. 1), and this cooling air then escapes via an outlet, to join the main stream of gas.

In particular, this cooling air flows through an internal cooling passage which is located inside the blade and terminates at the blade tip 14 at the emerging holes 15.

The body of the blade is profiled so that it defines a pressure wall 16 (on the left in all the figures) and a suction wall 18 (on the right in all the figures). The pressure wall 16 has a concave general shape and is presented to the stream of hot gases first, i.e. on the pressure side of the gases, whereas the suction wall 18 is convex and is presented to the stream of hot gases subsequently, that is to say on the suction side of the gases.

The pressure wall 16 joins the suction wall 18 at the leading edge 20 and at the trailing edge 22, these edges extending radially between the blade tip 14 and the top of the blade root 12.

As is apparent from the enlarged views of FIGS. 2 to 5, the blade tip 14, the internal cooling passage 24 is bounded by the inner face 26*a* of an end wall 26 that extends over the entire tip 14 of the blade, between the pressure wall 16 and the suction wall 18, and therefore from the leading edge 20 as far as the trailing edge 22.

At the blade tip 14, the pressure and suction walls 16, 18 form the rim 28 of a cavity 30 open in the direction away from the internal cooling passage 24, i.e. radially upwards (towards the top in all the figures).

As is apparent from the figures, this open cavity 30 is therefore bounded laterally by the internal face of this rim 28 and in the lower part by the outer face 26*b* of the end wall 26.

The rim 28 therefore forms a thin wall along the profile of the blade, which protects the tip 14 of the blade 10 from contact with the corresponding annular surface of the turbine casing.

Figure 4:
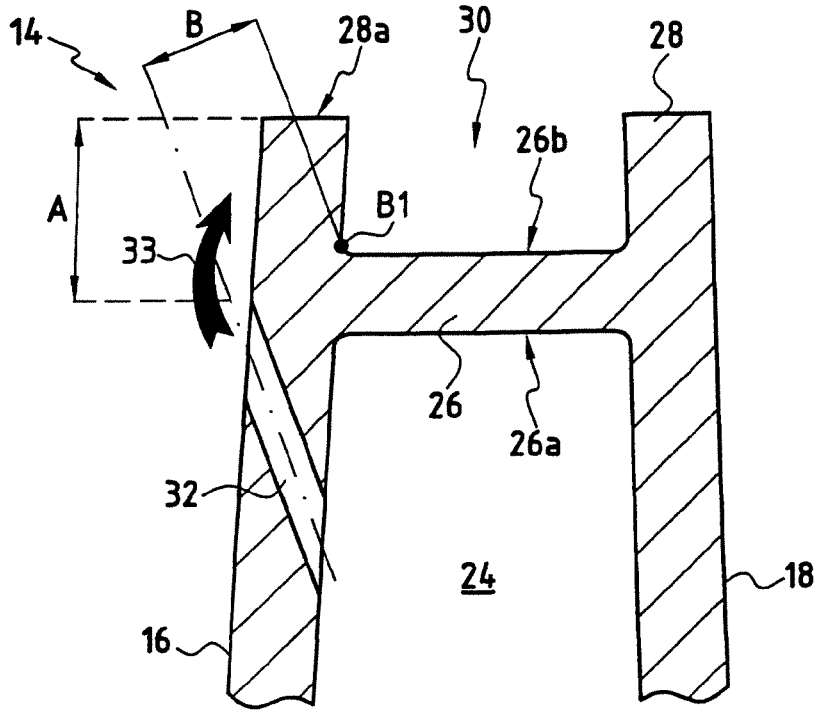
FIG.4 PRIOR ART
FIG. 4 is a longitudinal sectional view along IV-IV of FIG. 3.
Figure 5:
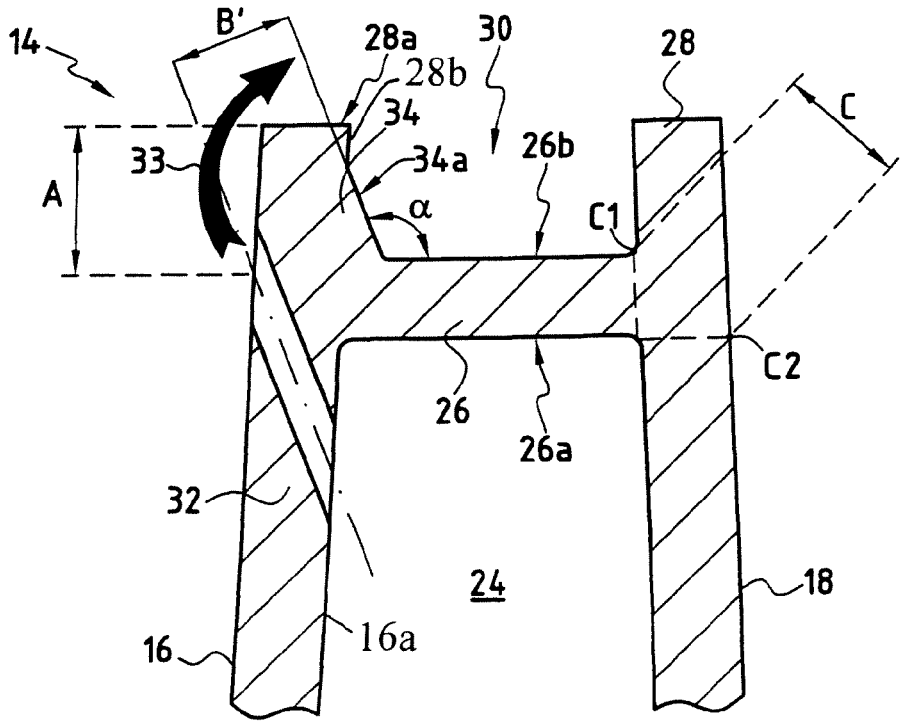
FIG. 5 is a view similar to that of FIG. 4, showing the modifications to the blade according to the present invention.

As may be seen more precisely in the sectional views of FIGS. 4 and 5, inclined cooling channels 32 pass through the pressure wall 16 to join the internal cooling passage 24 to the outer face of the pressure wall 16.

These cooling channels 32 are inclined so that they emerge at the top 28*a* of the rim, along the pressure wall 16, so as to cool this top 28*a* as much as possible.

As may be seen in FIGS. 4 and 5 by the thick black arrows 33, a jet of air leaving the cooling channels is directed towards the top 28*a* of the rim along the pressure wall 16.

In the case of known blades, as shown more precisely in FIG. 4, to maintain sufficient thermomechanical strength at the blade tip 14, it is necessary to leave a sufficient distance B between the outlet of the cooling channels 32 (the point of reference being the axis of these channels) and the intersection (B1) between the inner face of the rim 28 on the pressure wall 16 and the outer face 26*b* of the end wall 26 turned towards the said cavity 30.

This situation, which results from a mechanical construction requirement, means that the distance A, measured between the outlet of the cooling channels 32 (the point of reference being the axis of these channels) and the top 28*a* of the rim 28 on the pressure wall side, which is very much greater than the aforementioned distance B, is not large enough to cool the top 28*a* sufficiently.

To alleviate this drawback, according to the present invention, and as may be seen in FIG. 5, a material reinforcement 34 is provided between that face on the rim 28 which is turned towards the cavity 30, along the pressure wall 16, and the face 26*b* of the end wall 26 turned towards the cavity 30.

This material reinforcement 34 is advantageously produced so as to form a face 34*a*, turned towards the cavity 30, which is approximately plane in such a way that the transition between the outer face 26*b* of the end wall 26 turned towards the cavity 30 and the inner face of the rim 28 is made in stages. As can be seen from FIG. 5, an internal face 28*b*, located between the top 28*a* of the rim 28 and the face 34*a* of the reinforcement 34, is in alignment with an inner face 16*a* of the pressure wall 16 below the end wall 26 of the cavity 30. As further seen in FIG. 5, the internal face 28*b* is perpendicular to the top 28*a* of the rim 28 and to the face 26*b* of the end wall 26.

Thus, as can be been in FIG. 5, thanks to this material reinforcement 34 the aforementioned distance B, which must be maintained in order to guarantee the thermomechanical strength at the blade tip, becomes a distance B' measured between the outlet of the cooling channels 32 (the point of reference being the axis of these channels) and the face 34*a* of the reinforcement 34.

As this distance B' is maintained at the value of the distance B in FIG. 4, the presence of the reinforcement 34 allows the outlet of the cooling channels to be moved very significantly closer to the top 28*a* of the rim 28 along the pressure wall 16, since the aforementioned distance A is now less than the distance B' (see FIG. 5).

This reinforcement 34 is placed along at least one portion of the pressure wall. This reinforcement 34 may consist of a continuous band or of a series of protuberances, provided that this material reinforcement 34 is present in each transverse plane passing through a cooling channel 32.

In an illustrative embodiment produced in accordance with FIG. 5 and for the high-pressure turbine of an M88-type engine, a blade 10 made of a nickel-based alloy of the AM1 (NTa8GKWA) type was produced in which the material reinforcement stemmed directly from the casting step, forming a need along the entire length of the pressure wall 16. In particular, the dimensions of this example were the following:

height of the rim 28 (from the top 28*a* down to the outer surface 26*b* of the end wall 26): 1 mm;

thickness of the rim 28 and of the pressure 16 and suction 18 walls: 0.65 mm;

constant thickness of the end wall 26: 0.8 mm;

diameter of the cooling channels 32: 0.3 mm (a diameter between 0.25 mm and 0.35 mm could be envisaged);

distance A: 1.7 mm; and distance B: 1.2 mm.

Implementing the solution of the present invention, by adding the material reinforcement 34 over a width of 0.5 mm measured on the upper surface 26*b* of the end wall 26, results in the situation shown in FIG. 5, with the distance B=B'=1.2 mm, while the distance A is now equal to only 1 mm.

By moving the outlet of the cooling channels 32 closer to the top 28*a* by 0.7 mm achieves better cooling by 40° C. during operation of the high-pressure turbine.

That face of the reinforcement which is turned towards the cavity is approximately plane and makes, with that face of the end wall which is turned towards the cavity, an angle $\alpha$ equal to 112°.

The rim 28 which advantageously forms a thin wall, is of minimal thickness, which means less than 1.5 mm, preferably less than 1 mm and, optimally, of a thickness ranging between 0.3 and 0.8 mm.

Moreover, as can be seen from FIG. 5 illustrating the preferential embodiment:

at the location of cavity 30, the rim 28, and in particular its end, has a generally orthogonal direction with respect to the end wall 26 of the cavity, or more precisely with the upper surface 26*b* of the end wall 26 which is relatively flat (and horizontal on FIG. 5);

the reinforcement 34 is located at the base of the rim 28; and the cooling channels 32 present a constant section over their entire length.

The invention claimed is:

1. A hollow rotor blade for the turbine of a gas turbine engine, the blade comprising:

a suction wall and a pressure wall ending along a leading edge and a trailing edge, an internal cooling passage, a tip, an open cavity located at said tip of the blade and bounded by an end wall extending over the entire tip of the blade and a rim extending between said leading edge and said trailing edge along said suction wall and along said pressure wall and having a top, and cooling channels that connect said internal cooling passage to the outer face of said pressure wall, said cooling channels being inclined to said pressure wall in such a way that they emerge on the outer face of the pressure wall near the top of said rim, wherein said rim forms a thin wall and wherein a reinforcement of material is present between the rim and the end wall of the cavity along at least one portion of the pressure wall, the face of said reinforcement turned towards the cavity being approximately planar and inclined with respect to a portion of the internal face of the rim, which portion is adjacent to the top of said rim, whereby said rim is wider at its base adjacent to said end wall than at a remainder of the rim in such a way that the cooling channels emerge near said top of the rim without reducing the mechanical strength of the tip of the blade, wherein the portion of the internal face of the rim is in alignment with an internal face of the pressure wall below said end wall of the cavity.

2. A hollow rotor blade according to claim 1, wherein the distance between the outlet of said cooling channels and said top of the rim is less than the distance between the outlet of said cooling channels and said face of the reinforcement.

3. A hollow rotor blade according to claim 1, wherein the distance between the outlet of said cooling channels and said face of the reinforcement is at least equal to the distance that separates the intersection between the inner face of the rim level with said suction wall and the face of the end wall turned towards said cavity from the intersection between the outer face of said suction wall and the face of said end wall turned away from said cavity.

4. A turbine comprising a plurality of hollow rotor blades according to claim 1.

5. A turbine engine comprising a plurality of hollow rotor blades according to claim 1.

6. A hollow rotor blade according to claim 1, wherein said portion of the internal face of the rim is between said top of said rim and said face of said reinforcement.

7. A hollow rotor blade according to claim 1, wherein said portion of the internal face of the rim is perpendicular to said top of said rim.

* * * * *